United States Patent [19]

Alexander

[11] 4,336,739

[45] Jun. 29, 1982

[54] BULLET SEATING DIE

[75] Inventor: Kenneth L. Alexander, Lewiston, Id.

[73] Assignee: Omark Industries, Inc., Portland, Oreg.

[21] Appl. No.: 193,100

[22] Filed: Oct. 2, 1980

[51] Int. Cl.[3] ..... F42B 11/02

[52] U.S. Cl. ..... 86/43; 86/23; 86/24

[58] Field of Search ..... 86/23, 24, 25, 43, 45, 86/46

[56] References Cited

U.S. PATENT DOCUMENTS 2,700,915 2/1955 Pattison ..... 86/43 X 3,105,408 10/1963 Bachhuber ..... 86/25

4,248,132 2/1981 Blomseth ..... 86/24

*Primary Examiner*—Leland A. Sebastian

*Attorney, Agent, or Firm*—John W. Stuart

[57] ABSTRACT

A bullet seating die for use with an ammunition reloading press, the die including a member having an elongate bore for receiving a cartridge and a bullet seating member mounted in the bore. The bullet seating member is shiftable longitudinally within the bore by operation of a micrometer screw. Coacting grooves and a spring biased member produce a manually and audibly sensed click stop that indicates to the user preselected intervals of adjustment of the bullet seating member in the bore.

15 Claims, 7 Drawing Figures

FIG. 1
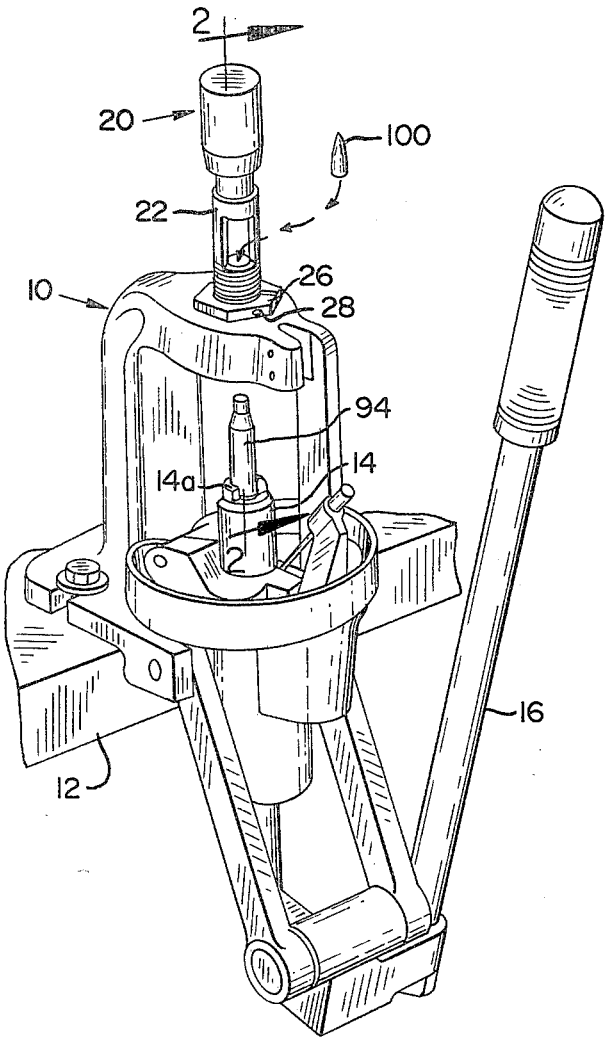
FIG. 2
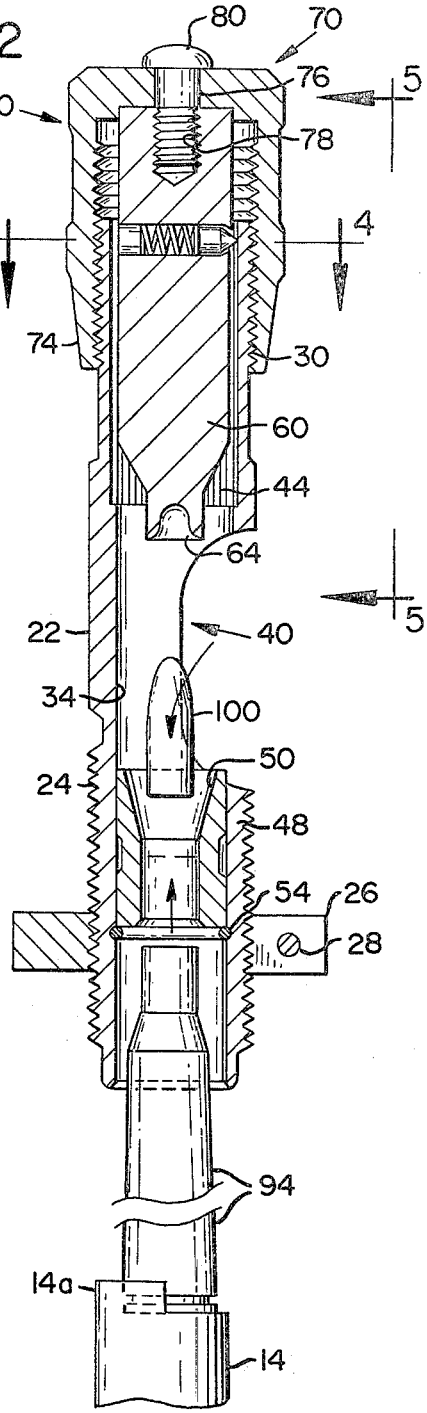
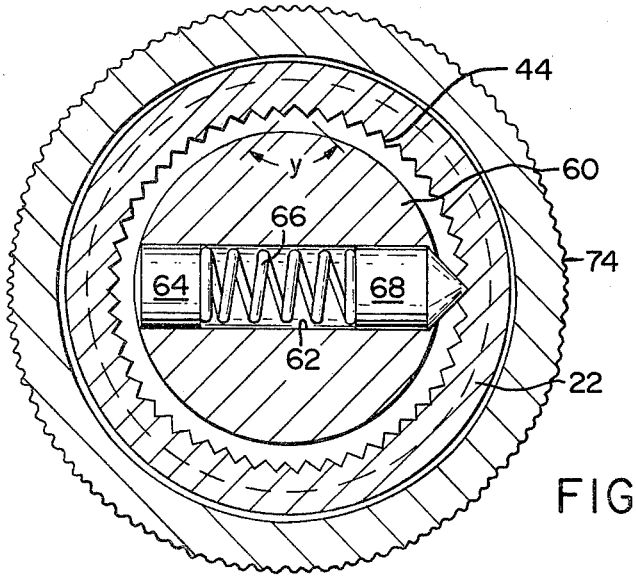
FIG. 4

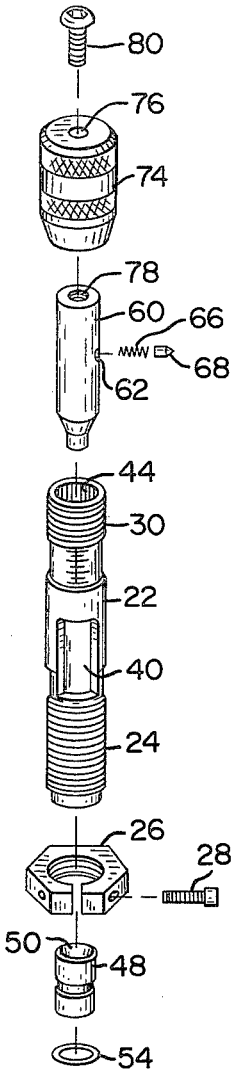
FIG. 6
FIG. 5
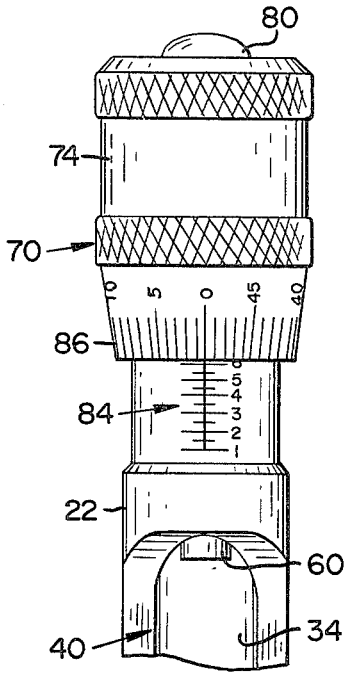
FIG. 3
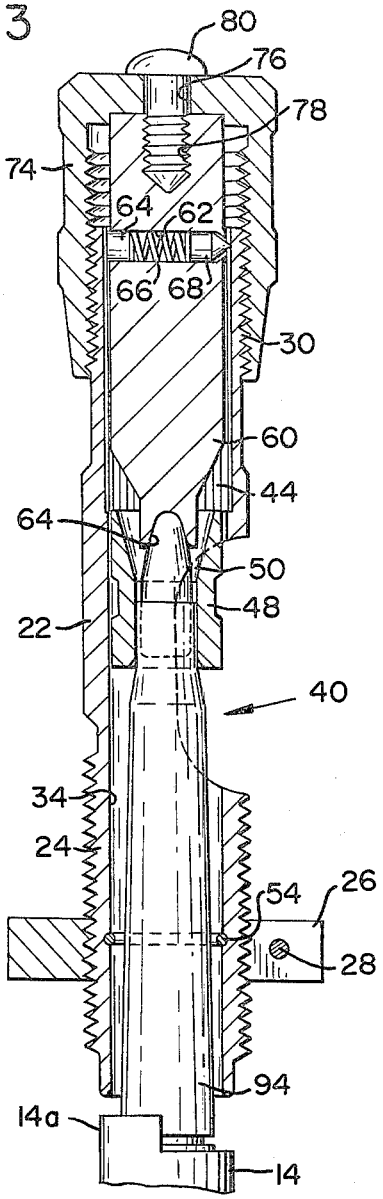
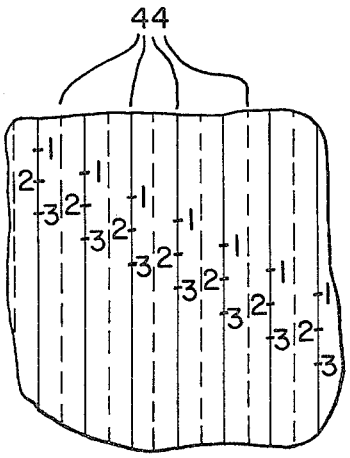
FIG. 7

BULLET SEATING DIE

BACKGROUND AND SUMMARY OF THE INVENTION

This invention relates to a device for accurately seating bullets in cartridges during a reloading process.

In the reloading of ammunition, it is known to provide a press frame which has a cartridge carrying plunger operable to shift a cartridge longitudinally into selected dies for properly forming the mouth or neck of the cartridge, for seating and pressing a bullet into the mouth of the cartridge, and possibly a final die for crimping the neck of the cartridge about the bullet.

Prior bullet seating dies have included a tubular member with a bore extending therethrough adapted to receive an open mouth cartridge which is shifted longitudinally into one end of the bore. A bullet seating member within the tube is positioned in such a manner that a bullet can be interposed between the bullet seating member and the mouth of a cartridge entering the bore. As the cartridge is pressed into the bore toward the bullet seating member the bullet will be pressed a selected depth into the mouth of the cartridge.

In the past, one form of bullet seating die has used adjustment screws for varying the position of the bullet seating member in the tubular bore. Such adjustment, however, was generally by trial and error, in that when it was desired to load a type of ammunition, the user by trial and error determined the setting of the bullet seating member relative to the bore to obtain the desired depth setting of the bullet. On such there was nothing to guide the user for subsequent settings.

More recently, micrometer screws have been attached to the bullet seating member. Two such devices are illustrated in U.S. Pat. Nos. 2,600,488 and 3,580,127 to Crump and Lee, respectively. Although these include micrometer screws, the bullet seating member is mounted for shifting on a separate screw stem longitudinally of the device so that the micrometer screw does not provide a constant direct reading of the position of the bullet seating head relative to the overall die. Explaining further, since the bullet seating head is shiftable relative to the micrometer screw by turning of the screw stem in such prior devices, the user can never be assured of the specific position of the bullet seating head relative to the overall die by merely observing the micrometer reading.

Further, prior art devices have not provided means for positively sensing intervals of shifting of the micrometer screw and its associated bullet seating head within the bore, nor have they provided means for releasably securing the micrometer screw and bullet seating member when placed in a selected seating position. A further disadvantage of prior art devices has been the lack of manually and audibly sensed indicia of repositioning intervals for the bullet seating member as it is shifted longitudinally in the die.

A general object of the present invention is to provide a novel bullet seating die for use in ammunition reloading which overcomes the disadvantages of previous devices as noted above.

A further object is to provide a novel bullet seating die in which a micrometer screw is attached to the bullet seating member in such a manner that the user can be assured that the reading on the indicia of the micrometer screw provides a valid indication of the relative position of the bullet seating member relative to the die body.

Yet another object is to provide a novel bullet seating die in which a micrometer screw is operatively attached to a bullet seating member and means is provided for producing a manually and audibly sensed indication of selected intervals of adjustment of the bullet seating member within the die.

More specifically, an object is to provide such a novel bullet seating die in which a plurality of grooves are provided within the device spaced radially about the bore in the body of the device, and a spring biased member is positioned to engage such grooves sequentially as the micrometer screw is operated to shift the bullet seating member longitudinally of the device, thus to provide both manually and audibly sensed (click stop) indications of the positioning of the device. Further, such grooves and spring-biased member provide a releasable holding of the adjustable elements within the device, whereby vibrations or other interferences will not produce misadjustment of the device.

A still further object is to provide such a novel bullet seating die in which each click stop indicates a selected interval of movement of the bullet seating member within the device, which interval may be on the order of 0.001 inch.

DRAWINGS

These and other objects and advantages will become more fully apparent as the following description is read in conjunction with the drawings wherein:

FIG. 1 is a perspective view of an ammunition reloading press on which is mounted a bullet seating die according to an embodiment of the invention.

FIG. 2 is an enlarged cross sectional view taken generally along the line 2—2 of FIG. 1 illustrating the bullet seating die of the invention;

FIG. 3 is a view similar to FIG. 2, but illustrating the device in a different operational stage.

FIG. 4 is an enlarged cross sectional view taken generally along the line 4—4 in FIG. 2;

FIG. 5 is a side elevation view of the upper portion of the device taken along the line 5—5 in FIG. 2;

FIG. 6 is an exploded view of the device illustrating separated parts thereof; and FIG. 7 is a view of grooves within the central bore of the device illustrating a pattern of movement of a spring-biased element therein.

DESCRIPTION OF PREFERRED EMBODIMENT OF THE INVENTION

Referring first to FIG. 1, at 10 is indicated generally an ammunition reloading press, or frame, which is secured to a table, or bench, 12. The reloading press is conventional, including a cartridge receiving base, or plunger, 14 which is raised and lowered (extended and retracted) by operation of a handle 16. The plunger has an arcuate lip 14*a* into which the base of the cartridge may be slipped with the rim of the cartridge being held thereby.

Secured to the upper portion of frame 10 is a bullet seating die 20 constructed according to an embodiment of the invention. The die includes an elongate body member 22 with a threaded lower portion 24 which screws into a threaded bore in the top of frame 10. A split lock nut 26 is operable to secure body member 20 in a selected position in the frame and a screw 28 (see FIG. 6) is operable to secure nut 26.

Referring to FIGS. 2, 3 and 6, it will be seen that body member 22 is an elongate cylindrical tube with threads 24 adjacent its lower end and another series of threads 30 adjacent its upper end. A bore 34 extends longitudinally through body member 22. An elongate aperture 40 intersecting bore 34 is provided along one side of and intermediate the ends of body member 22. A bullet may be inserted through aperture 40 into bore 34, as will be described in greater detail below.

Formed in the upper end of the bore in body member 22 are a plurality of elongate, radially space, longitudinally extending grooves, or depressions, 44. The configuration of these grooves is illustrated in FIG. 4. The grooves have opposed side walls which define therebetween an angle "Y" in the range of from 40° to 140°.

A sliding collar 48 is mounted for shifting longitudinally within bore 34. As is seen in FIGS. 2 and 3, collar 48 has a somewhat funnel-shaped bore 50 extending therethrough. The lower end of the bore has a diameter slightly greater than the diameter of the neck of a cartridge to be loaded, and the upper end diverges on progressing upwardly whereby a bullet may be droped therein and funneled into the waiting mouth of a cartridge.

A snap ring 54 fits within an annular groove adjacent the lower end of body member 22 to restrict the downward movement of collar 48. Thus, the collar may move downwardly only as far as illustrated in FIG. 2, and may be shifted upwardly as illustrated in FIG. 3.

A cylindrical bullet seating member 60 is mounted for shifting longitudinally within the upper end of bore 34 in body member 22. As is best seen in FIGS. 2 and 3, the lower end of seating member 60 has defined therein a depression 64 of a configuration complementing and adapted to receive the nose of a bullet to be loaded by the device.

Intermediate the ends of seating member 60 is a transverse bore 62. Mounted within bore 62 is a plug 64 which is secured in the position illustrated, a compression spring 66, and a groove-engaging element 68. As is best seen in FIG. 4, element 68 has a conical point adapted to engage a groove 44 and is mounted for sliding movement within bore 62 against the yieldable biasing force of spring 66.

At 70 is indicated generally micrometer screw adjustment means which is operable to produce selected shifting of bullet seating member 60 longitudinally of body member 22. The micrometer screw includes a sleeve, or head, member 74 which is internally threaded and screwed onto the threaded upper portion 30 of body member 22. A bore 76 in sleeve 74 is aligned with a threaded bore 78 in the top of seating member 60 to receive a screw 80 to secure the two together. The interconnection between the sleeve and bullet seating member is such that on rotation of the sleeve about the longitudinal axis of the body member, the threaded interconnection with the body member causes the micrometer screw assembly and bullet seating member to be shifted longitudinally of the body member a corresponding and equal distance. By loosening screw 80 the bullet seating member and sleeve may be rotated to a new orientation relative to each other and screw 80 then retightened. The purpose for this reorientation will be discussed in greater detail below.

As is illustrated in FIG. 5, numerical and line indicia are provided at 84, 86 on body member 22 and sleeve 74 respectively. These are provided to indicate the relative position of the bullet seating member within body 22.

In the preferred embodiment threads 30 on body member 22 and on sleeve 74 are 20 UNEF (unified national extra fine) and there are fifty (50) grooves 44 spaced radially about the interior of body member 22. With this configuration each time sleeve 74 and bullet seating member 60 are rotated whereby element 68 moves from one groove to the next, the bullet seating member is shifted 0.001 inch longitudinally of the body member 22. Each of the indicia lines 86 on sleeve 74 represents 0.001 inch, and the numerals "1, 2, 3, 4" of indicia 84 on body member 22 each indicates 0.01 inch of movement.

Describing the operation of the apparatus thus defined, plunger 14 without a cartridge thereon is raised to its greatest height by operation of handle 16. Die 20 is then screwed into press frame 10 to a position where the bottom of die body 22 is just slightly above the top of lip 14*a* as illustrated in FIG. 3. This clearnace may be on the order of 1/32 inch. When this positioning is completed, lock nut 26 is tightened against the press frame and set screw 28 extending therethrough is tightened to securely lock the die body in this position. The plunger then is lowered by operation of handle 16 to the position illustrated in FIG. 1. A cartridge 94 is inserted therein, with its rim held by lip 14*a*. Thus mounted, the open mouth of the cartridge is directed upwardly and aligned to be raised, or extended, into the bottom end of bore 34 in body member 22.

If the user has prior knowledge of the position in which the bullet seating member is to be placed relative to the body member for seating a selected bullet in such cartridge, it is a simple matter to screw the micrometer adjustment mechanism to the appropriate position noted by indicia 84, 86 to determine the appropriate placement.

Element 68 engaging grooves 44 within the device provides a positively sensed interval for the user to recognize movement between 0.001 inch increments of adjustment. Explaining further, as sleeve 74 is rotated manually, element 68 is forced out of one groove 44 and then is forced by spring 62 into the next groove producing an audible clicking sound and providing a manually sensed resistance at each 0.001 inch increment of rotation. Further, when the user has reached the selected adjustment position, element 68 resting in a groove 44 provides a positive resistance to rotation which minimizes the chance for the device to move out of adjustment during use. Element 68 and grooves 44 thus provide resistance to adjustment of the bullet seating member at preselected intervals of adjustment, which resistance may be manually sensed, yet may be overcome manually to permit readjustment.

If the user does not have prior knowledge of the appropriate adjustment of the bullet seating member, a trial position may be selected. Preferably the first trial position will leave the cartridge and bullet combination somewhat longer than desired. Measurement of the cartridge and bullet overall length, as compared to the desired length, will indicate the micrometer screw adjustment necessary to achieve desired results. The setting thus established then may be recorded for future use.

Once the appropriate setting has been established and set, handle 16 is operated to raise cartridge 94 into position adjacent the bottom of collar 48 and a bullet 100 is inserted through aperture 40 and released tail down into the funnel portion of collar 48, coming to rest in the mouth of cartridge 94. The handle 16 then is operated further to raise cartridge 94, collar 48, and bullet 100 to a position where the bullet engages the bullet seating member and is stopped. Upon further raising of cartridge 94, the bullet is forced into the neck of the cartridge as illustrated in FIG. 3.

Referring to FIG. 7, a section of the grooved interior wall of body member 22 is illustrated. The solid vertical lines illustrate the peaks, or radially inwardly directed portions, thereof. The dashed vertical lines illustrate the valleys, or radially outward portions, of the grooves. In this figure at cross points noted "1" are indicated generally the regions engaged by the point of element 68 as it is rotated and spirals downwardly within bore 34 upon rotation of the micrometer screw. Since this may tend to wear a path, or spiral groove, along these areas, it is desirable to be able to reorient this element within the bore. This is easily done by loosening screw 80, rotating bullet seating member 60 relative to sleeve 74, and then securing the screw.

If the bullet seating member is rotated the distance of only one groove, the point of element 68 would traverse a spiral path illustrated by cross marks "2". If shifted two grooves the marks "3" would indicate the path. Thus, it is seen that further advantages are obtained by being able to reorient bullet seating member 60 relative to sleeve 74 of the micrometer screw mechanism.

With the apparatus of the invention, it is a simple matter for a user to position the bullet seating member as desired. A user may remove the die from the frame or may set it to seat bullets of various sizes in cartridges of various sizes, and then reposition it to the appropriate setting by use of the micrometer indicia and the bullet seating member being secured thereto for corresponding and equal movement with the micrometer screw.

Further advantages reside in the presence of the manually and audibly sensed interengagement of element 68 with grooves 44. Explaining further, at each adjustment interval, in this case 0.001 inch, the user manually senses a yieldable resistance and hears an audible click, as element 68 is urged out of one groove 44, is advanced to the next, and then is rapidly pressed by spring 66 into the next groove.

While a preferred embodiment of the invention has been described herein, it is recognized that variations and modifications may be made without departing from the spirit of the invention.

I claim:

1. A bullet seating die comprising a body member having an elongate bore therein, a bullet seating member mounted in said body member for shifting longitudinally of said bore between selected adjusted positions, and yieldable stop means operable to produce resistance to adjustment of said seating member at preselected intervals of adjustment, which resistance may be manually sensed and overcome to permit readjustment, said stop means comprising a plurality of depressions defined in one of said members and an element on the other of said members yieldably biased into a position to engage said depressions as said seating member is shifted to selected adjusted positions.

2. The die of claim 1, wherein said seating member is operatively interconnected to said body member by threaded engaging means, said seating member being rotatable about an axis extending longitudinally of said bore and being shiftable longitudinally of said bore on rotation, and said depressions comprise a plurality of elongate grooves spaced radially about their associated member and extending longitudinally relative to said bore.

3. The die of claim 2, wherein said grooves and element are configured to permit a portion of said element to enter a groove at a selected adjusted position and to be forced from said groove under the effect of manual rotation of said seating member.

4. The die of claim 2 wherein a groove has opposed sides which define therebetween an included angle in a range from 40°–140°.

5. A bullet seating die for use in an ammunition reloading press having means operable to shift a cartridge case longitudinally between retracted and extended positions in said press, said die comprising a body member having an elongate bore therein with an open end adapted to receive a cartridge as it is shifted from its retracted to its extended position, a bullet seating member mounted in said bore and spaced from said open end having a bullet-engaging portion against which a bullet interposed between a cartridge and seating member may be supported, whereby the bullet is pressed into the cartridge as the cartridge and seating member are moved toward each other, said seating member being mounted in said body member for selected shifting toward and away from said open end to adjust the distance a bullet is pressed into a cartridge, and yieldable stop means operable to produce resistance to adjustment of said seating member at preselected intervals of adjustment, which resistance may be manually sensed and overcome to permit readjustment, said stop means comprising a plurality of depressions defined in one of said members and an element on the other of said members yieldably biased into a position to engage a depression as said seating members is shifted to selected adjusted positions.

6. The die of claim 5, wherein said seating member is operatively interconnected to said body member by threaded engaging means.

7. The die of claim 6, wherein said threaded engaging means comprises micrometer screw means threadably screwed to said body member for rotation about an axis extending longitudinally of said body member and for shifting longitudinally of said body member on rotation, said seating member being secured to said micrometer screw means for rotation and longitudinal movement therewith, and said depressions comprise a plurality of elongate grooves spaced radially about their associated member and extending longitudinally relative to said bore.

8. The die of claim 7, wherein a groove has opposed sides which define therebetween an included angle in a range from 40° to 140°.

9. The die of claim 7, wherein said micrometer screw means includes indicia indicating the position of said seating member within said bore.

10. The die of claim 7, which further comprises releasable securing means interconnecting said micrometer screw means and said seating member permitting release of said seating member from said micrometer screw means, relative rotation therebetween, and resecuring to establish reorientation therebetween.

11. The die of claim 7, wherein the spacing of said depressions is so related to the micrometer screw means advance to produce sequential resistance to adjustment at substantially equal intervals of movement of said seating member longitudinally of said bore.

12. The die of claim 5, wherein said seating member is operatively interconnected to said body member by threaded engaging means, the seating member being rotatable about an axis extending longitudinally of said bore and being shiftable longitudinally of said bore on rotation, and said depressions comprise a plurality of elongate grooves spaced radially about their associated member and extending longitudinally relative to said bore.

13. The die of claim 12, wherein said grooves and element are configured to permit a portion of said element to enter a groove at a selected adjusted position and to be forced from such groove under the effect of manual rotation of said seating member.

14. The die of claim 5, wherein the configuration of a depression, the depth of a depression, and the biasing force of said biasing means are such that as the seating member is shifted from one adjusted position to the next said element is forced into a depression to produce an audible sound to further identify to the user a selected position for the seating member.

15. A bullet seating die for use in an ammunition reloading press having means operable to shift a cartridge case longitudinally between retracted and extended positions in said press, said die comprising a body member having an elongate bore therein with an open end adapted to receive a cartridge as it is shifted from its retracted to its extended position, a bullet seating member mounted in said bore and spaced from said opening, said member having a bullet-engaging portion against which a bullet interposed between the cartridge and seating member may be supported, whereby the bullet is pressed into the cartridge as the cartridge and seating member are moved toward each other, adjustment means mounting said bullet seating member in said body member for selected shifting toward and away from said open end to adjust the distance a bullet is pressed into the cartridge, said adjustment means including micrometer screw means operatively connected to said body member for shifting longitudinally thereof and securing means securing said bullet seating member to said micrometer screw to produce shifting of said bullet seating member in corresponding and equal relation to shifting of said micrometer screw, said securing means being releasable to permit said bullet seating member to be rotated about an axis extending longitudinally of the bore to a new orientation and upon resecuring to maintain said new orientation relative to said micrometer screw and resume the same position relative to said micrometer screw longitudinally of said bore, and yieldable stop means operable to produce resistance to adjustment of said seating member at preselected intervals of adjustment, which resistance may be manually sensed and overcome to permit readjustment, said stop means comprising a plurality of depressions defined in one of said members and an element on the other of said members yieldably biased into a position to engage said depressions as said seating member is shifted to selected adjusted positions.

* * * * *